US006703786B2

(12) United States Patent
Tannenbaum

(10) Patent No.: US 6,703,786 B2
(45) **Date of Patent: *Mar. 9, 2004**

(54) SYSTEM AND METHOD FOR IN-LINE CONTROL OF ELECTRIC POWER

(75) Inventor: David H. Tannenbaum, Dallas, TX (US)

(73) Assignee: Union Beach, L.P., Dallas, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 9 days.

(21) Appl. No.: 09/475,096

(22) Filed: Dec. 30, 1999

(65) Prior Publication Data

US 2002/0011805 A1 Jan. 31, 2002

(51) Int. Cl.[7] ..... H05B 37/02; H01H 35/00

(52) U.S. Cl. ..... 315/149; 362/806; 362/376; 315/159

(58) Field of Search ..... 315/149–159, 315/292–296, 360, 362, 119; 362/376, 542, 806, 395; 439/236, 502

(56) References Cited

U.S. PATENT DOCUMENTS 3,872,428 A * 3/1975 Boisvert ..... 240/52.1
3,999,099 A * 12/1976 Herion ..... 315/93
4,626,747 A * 12/1986 Nilssen ..... 315/209 R
5,089,229 A * 2/1992 Heidt et al. ..... 422/64
5,265,000 A * 11/1993 Lin ..... 362/427
5,357,170 A * 10/1994 Luchaco et al. ..... 315/159
5,387,845 A * 2/1995 Nilssen ..... 315/209 R
5,442,177 A * 8/1995 Boulos et al. ..... 315/159
5,455,487 A * 10/1995 Mix et al. ..... 315/150
5,598,042 A * 1/1997 Mix et al. ..... 315/154
5,624,175 A * 4/1997 Gelormino et al. ..... 362/191
5,637,964 A * 6/1997 Hakkarainen et al. ..... 315/321
5,646,383 A * 7/1997 Deem ..... 362/806
5,649,759 A * 7/1997 Korte ..... 362/226
5,764,146 A * 6/1998 Baldwin et al. ..... 340/567
5,920,259 A * 7/1999 Shpater ..... 340/565

* cited by examiner

*Primary Examiner*—Wilson Lee
(74) *Attorney, Agent, or Firm*—Fulbright & Jaworski LLP

(57) ABSTRACT

There is disclosed an in-line free-form sensor for controlling power flow to a utilization device. The in-line sensor is contained within a housing attached along a power cord and the housing contains no externally-visible moving parts. The sensor can be trained to respond to certain stimuli, such as light, sound, temperature, human presence, and/or motion. The sensor can control the power directly by operation of a switch or can provide signals for use by a device external to said housing.

36 Claims, 2 Drawing Sheets

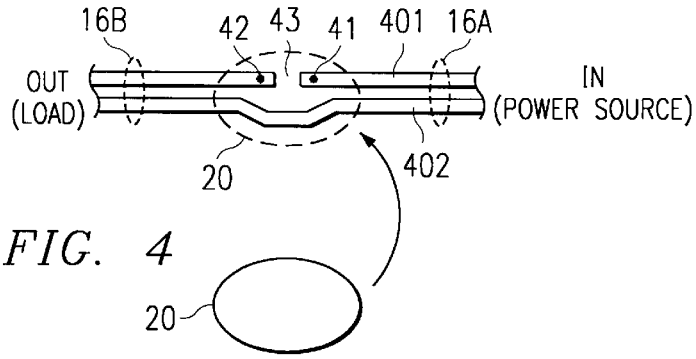
FIG. 4
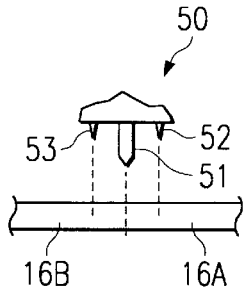
FIG. 5
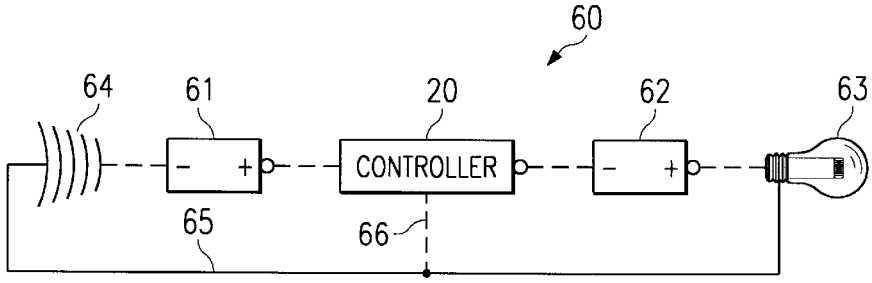
FIG. 6
FIG. 7
(PRIOR ART)
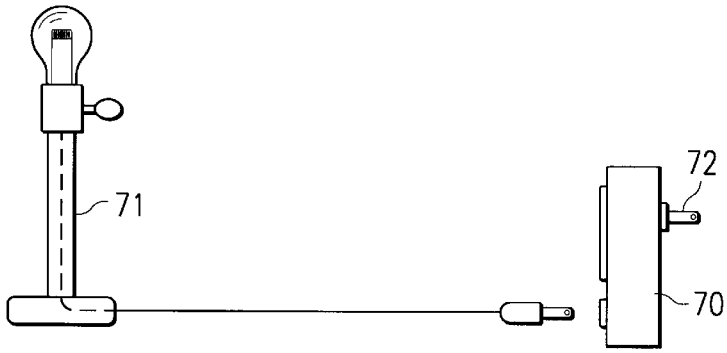
FIG. 8
(PRIOR ART)
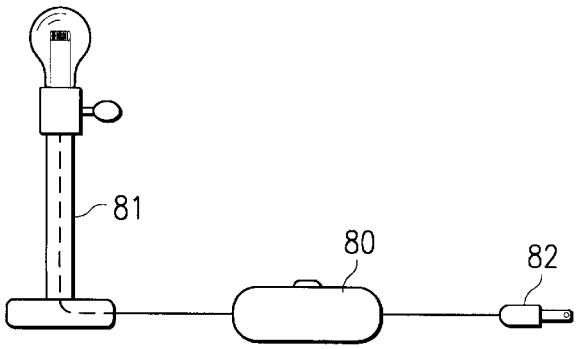

SYSTEM AND METHOD FOR IN-LINE CONTROL OF ELECTRIC POWER

TECHNICAL FIELD

This invention relates to power control devices and more particularly to a device that can be attached in-line to a power line and which can be selectively controlled from selectable parameters to enable and disenable power along said power line without manipulation of externally visible switches.

BACKGROUND

It is common practice to connect lamps and other devices to timers so as to control the on-off time of the lamp. These timers are traditionally plugged into a wall socket and the lamp (or other device) is then plugged into a switched power socket on the side of the timer. The user then inserts pins, or moves small levers or otherwise sets the start and stop (on and off) times of the switched socket. The lamp then turns on at the set time and turns off at another set time.

These devices are bulky and unattractive and sometimes even noisy. The use of such timers in an outdoor situation is problematical as they are not usually designed for damp or wet conditions. Because such timers have moving parts and further because of cost considerations, it is difficult to waterproof them. However, even assuming the timer could be waterproofed sufficiently to be used in outdoor situations a further problem exists in that outdoor electrical sockets usually are covered by a flip-up cap that protects the socket from moisture when the socket is not in use. The bulky timers simply do not fit into sockets which are so protected since the flip-up portion of the cover blocks the timer from being inserted fully into the outdoor socket.

Also, in the prior art, there are timer devices which have a light sensor built in so that the sensor can detect dusk. That same device can then be set to remain on for a selected period of time or, optionally, all night. Devices of this type are now available with a "pigtail" cord and plug so that the device can be plugged into an electric outlet and the device to be controlled is then plugged into the device. The "pigtail" cord allows the device to hang down from a wall electrical outlet. As in all prior art devices of this type, the "pigtail" device is bulky and requires physical intervention by the user to set the parameters on the surface of the device. These devices do, however, allow for use with outdoor sockets and sometimes are even waterproofed.

In addition to the physical problems inherent with current power control devices, they are typically bulky and unattractive and not suited for use in decorated situations, such as a home living area. The prior art devices require physical contact by the user to set the parameters. This physical contact then requires the surface of the device to include switches or other mechanical devices adapted to accept the user's physical commands and/or provide the user with feedback information as to the status of the set parameters.

Thus it is desired to construct a switch which is neither unsightly when in use indoors nor too bulky to use outdoors.

It is further desired to construct such a switch so as to be relatively inexpensive, easy to install and simple to establish the operational parameters therein. It is a still further object of my invention to construct a switch such that there is not a need for physical contact by the user with externally fashioned switches in order to set the control parameters.

SUMMARY OF THE INVENTION

These and other objects, features and technical advantages are achieved by a system and method which are achieved by a switch designed to be installed in-line along a power line. The switch will have contained within it a device, such as a clock mechanism (or a sensor of one type or another) which controls the flow of power from the proximal end (plug end) of the power line to the distal end (the lamp or other device). The in-line switch should be made relatively small and the mechanism (whether mechanical or electrical) could be, if desired, made of nano technology parts, all of which should be sealed within the housing. The user could, in the case of a timer, touch sensitive spots around the edge of the device to set the on-off times, or the user may speak the time or send other timing control signals.

There are many methods of setting the operational parameters. One method, as discussed above, can be by touching sensitive spots on the surface of the device. Another can be by the use of a magnet positioned by a user at selected spots. Another method of setting the parameters is by allowing the mechanism to self-learn. For example, the device could obtain power from the power line (or from a battery if desired) and can use the power line for timing based on the 60 cycle per second wave form. In this form of operation, the device, when installed, would have its output closed so as to pass power continuously. The user could, for example, be instructed to turn the lamp (or other device) at the end of the power line on and off three times in rapid succession at exactly noon. The device would then recognize that it is noon and would then set its internal clock to noon. The user then would turn the light on at, say 7:00 p.m. and off at 11:00 p.m. The device would sense the power flow start time and the power flow stop time and would then duplicate those times until changed. Change could occur, for example, when the user flipped the lamp switch twice in rapid succession. The device would sense the impedance change and know that a program change was to follow.

Of course, many such learning scenarios could be utilized to allow the device to "learn" without requiring the use of externally mounted switches or mechanisms. For example, one or more small holes could be positioned on the surface of the device and atmospheric pressure changes (caused by opening and closing a human palm around the device) could be used to teach the device the operating parameters.

In addition, if the device were designed to sense impedance changes (or other signals from the distal end), then the light (or other device) could be turned on by the user at any time simply by turning the lamp switch off (its normal position would be always on) and then turning the switch on again. In this example, the lamp had been off because the timer was in the off mode with its switch open. The on-off switch in the lamp, however, had been in the on position since power is being controlled by the in-line switch. The in-line switch senses the change in on-off position of the lamp switch (or any other specific impulses) and immediately turns on. The in-line switch remains closed (power flowing) until it senses that the user has turned the lamp switch off and then on again. The in-line switch then goes into its pre-established mode of timed operation whereby the lamp is turned off (even though the lamp switch is now on). The lamp is turned on at the preset time by the in-line switch, having "learned" its parameters by "observation" of the user's requirements.

The controller could be programmed during manufacture, or by signals received over the power lines (for example from a master controller or PC), or by signals received by RF or infrared transmission. The shell of the controller could contain the antenna or could allow sound, or IR to pass through it. A small DSP or other device could be designed to change its parameters and its operating characteristics in response to many different stimuli. While not essential, I have a vision of the device being about one inch in length and having an egg-like shape. Of course, any shape could be used.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWING

For a more complete understanding of the present invention, and the advantages thereof, reference is now made to the following descriptions taken in conjunction with the accompanying drawing, in which:

FIGS. 4 and 5 show one alternative of a wire and the connections thereto;

FIG. 6 shows a portable version of the invention; and

FIGS. 7 and 8 show prior art devices.

DETAILED DESCRIPTION

Figure 1:
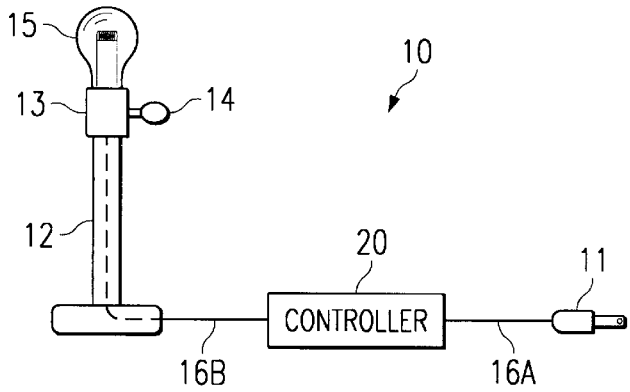
FIG. 1 is an overview of the on-line controller being used in one application.
Figure 3A:
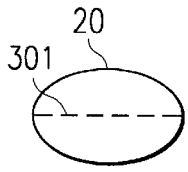
FIGS. 3A, 3B and 3C show alternative physical examples of the controller.

FIG. 1 shows one embodiment 10 of my invention. Lamp 12 (or any other consumption device) is attached to power line 16B at a distance away from power plug 11. Lamp 12 is shown with socket 13, switch 14 and bulb 15. Controller 20, which ideally would be constructed as two half shells (as shown in FIG. 3A) with an optional water-tight seal 301 at the intersection of the two shells is inserted between sections 16A and 16B of the power cord. Typically, there would be no movable parts visible to a view when the shells are held together, by screws, snaps, glue or any other suitable means. However, as shown in FIG. 3C, there could be one or more holes 32 in housing 31 to allow light and/or pressure, (or any other detectable material) to enter the device.

Figure 2:
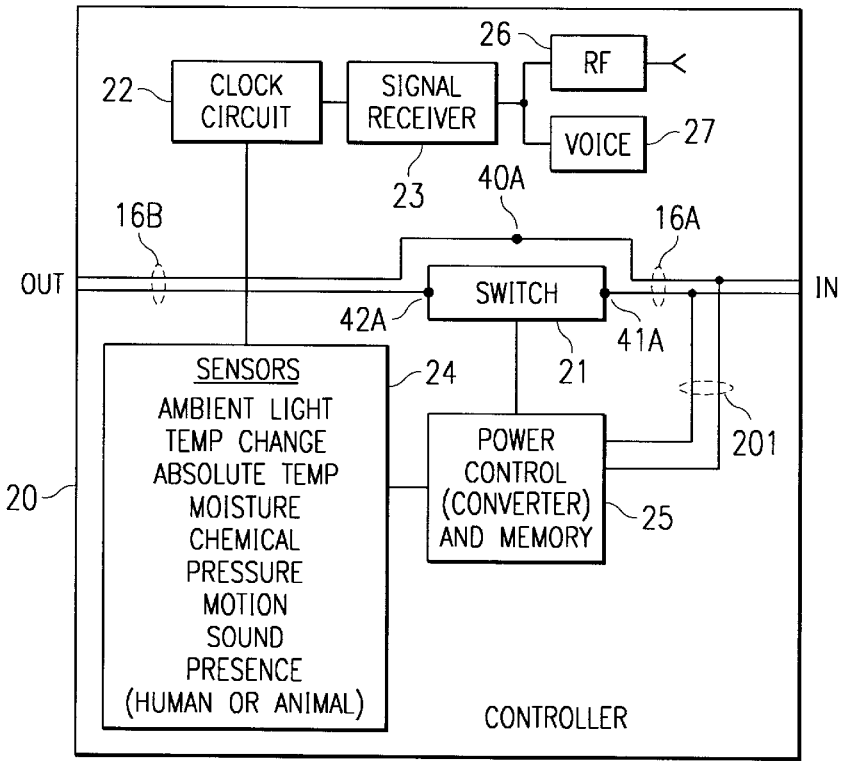
FIG. 2 shows details of the controller.

As shown in FIG. 2, there resides within controller 20 a switch mechanism 21 for selectively allowing power to flow or not flow from the input to the output. Switch 21 can be constructed using conventional technology, or electronic technology, and will be controlled physically by the assertion of force against the switch or electrically by control circuitry. This is controlled by power control 25, which could be powered from line power, via cable 201 or from an internal power source (not shown).

Switch 21 includes, for example a power diode controllable by electronics operating from an electronic timing circuit and can, for example, enable by mechanism 50 (FIG. 5). The electronics could be controllable by a sense of moisture, pressure, gas detection, light levels, RF energy, etc., any one or more of which would be communicated through a membrane or other structure of device 20, including pressure applied by a user.

A miniature timer could be constructed using nano technology and could be set by pulses (or other signals) received by one or more of sensors 24. The external signals could come, for example, from RF (or light) signals through the housing via detector 26 to sensor 23. Controller 20 could include a clock 22 and/or voice control unit 27. Voice control unit 27 could, for example, accept voice (or other sound) commands which would then go into the memory portion of power controller 25.

FIG. 3A shows controller 20 configured as an "egg" shape with an optional 'o' ring seal 301 for making the mechanism water tight.

Figure 3B:
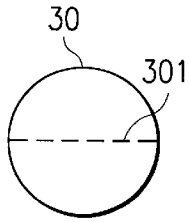
Figure 3C:
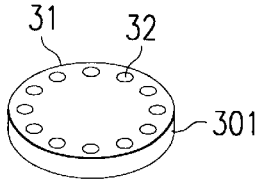

FIG. 3B shows a coin-shaped controller 30 (an alternate shape for controller 20) while FIG. 3C shows optional holes 32 on a surface of controller 31 (another alternate shape for controller 20). The wire (or other power line type) would pass through controller 20 (30, 31) and the flow of power from the input to the output would be controlled by parameters set within the controller. These parameters would respond to received conditions and control the power flow along the power line.

FIG. 4 shows input power line 16A having two conductors 401, 402, with conductor 401 being "broken" between terminal 41 and 42 in the conventional manner. Controller 20 then would, when appropriate, control the flow of electricity across gap 43 between points 41 and 42 by, for example, terminals 52 and 53 of device 50 shown in FIG. 5.

Also shown in FIG. 5, device 50 includes a knife edge 51 for cutting wire 401 to create gap 43 (FIG. 4). Device 50 contains a mechanism for bridging the electrical gap between points 41 and 42 upon command of controller 20.

FIG. 6 shows one embodiment 60 of controller 20 being used with battery power. In this embodiment, spring 64 would force battery 61 against controller 20 which in turn is forced against battery 62 and in turn against bulb 63. Controller 20 obtains power from battery 61 and, if necessary from (battery –) over leads 66 and 65 via spring 64. Controller 20 can be made to respond to pressure, light, time, or any other desired stimuli.

FIG. 7 shows a typical prior art wall mounted timer 70 controlling loop 71. Plug 72 of device 70 plugs into a typical wall socket.

FIG. 8 shows a line mounted on-off switch 80 connected in-line between plug 82 and lamp 81. Also, as discussed above, there presently is a device (70) of the type shown in FIG. 7 with a plug-in pigtail. Such a device requires externally mounted controls and requires the load to be plugged into a socket mounted on the device. While switch 80 is close in size to what is contemplated by this invention, it requires externally applied pressure each time an operation is to be performed.

Controller 20 could be designed such that the type of stimuli sensor is easily interchangeable.

Although the present invention and its advantages have been described in detail, it should be understood that various changes, substitutions and alterations can be made herein without departing from the spirit and scope of the invention as defined by the appended claims. For example, while I have been discussing power lines, this same concept could be applied to other forms of in-line applications, such as, for example, the in-line (free-form) control of watering heads for use in a garden. By free-form I mean a power distribution system that is not permanently attached to a structure such that the switch is free to move in conjunction with the power-line and essentially becomes integral to the line. Also note that the preestablished conditions could be entered by the user or by the manufacturer and may or may not be modified or changed by the user. By way of another example, the controller need not control power to the appliance at the end of the line, but rather could simply act as a "parasite" and use the power line to obtain power for its own internal use. In such a situation, the "load" would be internal to the controller. Such use, for example, could be as a detector (motion, gas, etc.) and the result of such detection could be an audible signal or a signal transmitted by some other mechanism, such as RF signals.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A self-contained controller for use in controlling the flow of electricity from an electrical source to an electrical load, said controller comprising:

a housing for attaching to a free form power line, the power line not permanently attached to a structure such that said housing is free to move in conjunction with the power line, said housing adapted for attaching between said source and said electrical load and fitting around at least one wire of said power line at a point in said power line where said power line remains in free form even after said attachment;

said housing containing a switch for enabling and disabling the flow of electricity to said load, said switch operable in response to certain externally sensed criteria without contact by a user at the time said power is enabled or disabled.

2. The controller of claim 1 wherein said criteria is selected from the group consisting of:

pressure sensors, light sensors, time sensors, chemical sensors, temperature sensors, rate of rise sensors, smoke sensors, moisture sensors, presence sensors, and sound sensors.

3. The controller of claim 1 wherein said controller further includes:

contacts for cutting into said power line for obtaining power from said power lines for internal operation of said controller.

4. The controller of claim 1 wherein said criteria are established by inputs received from external sources.

5. The controller of claim 4 wherein said inputs are received from the group of at least one of the following: pressure inputs, sound commands, RF signals, and power line signals, including impulse signals.

6. A device for controlling power delivery along a free form power cord, said device comprising:

a self-contained controller for attaching permanently along a free form portion of power cord and supported by said free form power cord at a point on said power cord where said power cord is in free form, said power cord remaining in free form after said attachment, said controller determining without human intervention that certain parameters have been met; and operative under control of such determination for modifying said power delivery along said cord.

7. The device of claim 6 wherein said controller is enclosed within a housing, said housing having an outside area and an inside area where said controller resides, and wherein said parameters are entered into said controller without the use of mechanical devices on said outside surface of said housing.

8. The device of claim 6 wherein said controller is operative under control of the attainment of a certain time.

9. The device of claim 6 wherein said controller is operative under control of certain ambient light levels.

10. The device of claim 6 wherein said controller is operative by power obtained from said power cord.

11. The device of claim 6 wherein said controller is operative under control of the attainment of a certain time and further operative under control of the attainment of another time.

12. The device of claim 6 wherein said controller is operative under first control of certain ambient light levels and further operative under second control of the attainment of a time period subsequent to said first control.

13. The device of claim 8 wherein said controller further includes:

a clock and wherein said certain parameters are time settings selectively established with respect to said clock.

14. The device of claim 6 wherein said device is constructed as a pair of half shells mountable around said power cord.

15. The device of claim 14 further including means within said half shells for cutting into said power line.

16. The device of claim 6 wherein at least a portion of said controller is nano tech derived.

17. The device of claim 6 wherein said controller further includes a light sensor and wherein said certain parameters are ambient light settings.

18. The device of claim 6 wherein said power cord has a plug on the proximal end and a power outlet on the distal end, and wherein said device is positioned between said proximal and distal ends, such that said device is capable of obtaining operational power from said power cord when said plug is connected to a source of power and such that said device is capable of selectively delivering power to said power outlet.

19. The device of claim 6 wherein said determination is selected from at least one of the group consisting of:

pressure sensors, light sensors, time sensors, chemical sensors, temperature sensors, rate of rise sensors, smoke sensors, moisture sensors, pressure sensors, presence sensors, and sound sensors.

20. The device of claim 6 wherein said parameters are established by inputs received from external sources.

21. The device of claim 20 wherein said inputs are received from at least one of the group consisting of:

pressure inputs, sound commands, RF signals, power line signals, impulse signals, and IR signals.

22. The method of adding automatic control of power along a free form power line; said method comprising the steps of:

attaching a free form power switch to said power line between the proximal and distal ends of said power line outside of any supported housing, said power line remaining in free form after such attachment, said power switch operative to close and open under pre-established conditions independent of externally applied force at the time of opening and closing, and wherein said closed condition causes power to flow from said proximal end to said distal end and wherein said open condition causes said power flow to stop; and establishing within said switch said preestablished conditions.

23. The method of claim 22 wherein said preestablished conditions are selectively programmable.

24. The method of claim 22 wherein said attaching step includes cutting into said power line to both obtain power therefrom and to create a gap therein.

25. The method of claim 22 wherein said preestablished conditions are selected from at least one of the group conditions of:

ambient light, temperature, moisture, sound, pressure, chemical, presence.

26. A controller for connecting into a free form power line between a plug connected to the end of said power line and a load, said controller comprising:

a housing for enveloping said power line in free form fashion such that said housing is free to move in conjunction with said power line and wherein said housing, when enveloping said power line, becomes integral to said line, said line remaining in free form after said enveloping, said housing having an interior and an exterior; said housing having no moving parts available to said exterior of said housing; said housing further including within said interior at least one sensor connectable into said power line, each said sensor operable by a stimulus applies to said exterior of said housing; and wherein each said sensor operates from one or more of the following stimuli: pressure, sound, gas, moisture, proximity, light, time.

27. The controller of claim 26 wherein said controller includes a CPU.

28. The controller of claim 26 wherein at least one of said sensors is constructed using nano technology.

29. The controller of claim 26 wherein at least one of said sensors contains at least one parameter for setting the levels upon which said sensor will operate in response to said received stimulus.

30. The controller of claim 29 wherein the level of said contained parameter is selectable from stimuli delivered to said exterior of said housing.

31. The method of establishing a controller along a free form power line, said method comprising the steps of:

attaching in free form fashion a housing to said free form power line, said housing not being permanently attached to a structure such that said housing is free to move in conjunction with the power line, said power line remaining in free form after said attaching, said housing having an interior and an exterior; said housing having no moving parts available to said exterior of said housing; said housing further including within said interior at least one sensor connectable into said power line, each said sensor operable by a stimulus applied to said exterior of said housing; and wherein each said sensor operates from one or more of the following stimuli: pressure, sound, gas, moisture, proximity, light, time.

32. The method of claim 31 further including the step of:

interchanging one sensor type for another sensor type within said housing.

33. The method of claim 31 wherein said sensor obtains its power at least in part from said power line.

34. The method of claim 31 wherein said sensor is operative to send a control signal to an element external to said housing.

35. The method of claim 34 wherein said control signal is the provision of power to a load connected to said power line.

36. The method of claim 31 wherein said attaching step includes cutting into said power line to both obtain power therefrom and to create a gap therein.

* * * * *